US008376260B2

(12) United States Patent
Granger

(10) Patent No.: US 8,376,260 B2
(45) Date of Patent: Feb. 19, 2013

(54) DEVICE FOR LOADING STRIPS OF WIPING MATERIAL FOR WIPING MATERIAL DISPENSING APPARATUSES

(76) Inventor: Maurice Granger, St. Priest en Jarez (FR)

( * ) Notice: Subject to any disclaimer, the term of this patent is extended or adjusted under 35 U.S.C. 154(b) by 776 days.

(21) Appl. No.: 12/524,208

(22) PCT Filed: Jan. 24, 2008

(86) PCT No.: PCT/FR2008/050106
§ 371 (c)(1),
(2), (4) Date: Jul. 23, 2009

(87) PCT Pub. No.: WO2008/107608
PCT Pub. Date: Sep. 12, 2008

(65) Prior Publication Data

US 2010/0044493 A1 Feb. 25, 2010

(30) Foreign Application Priority Data

Jan. 24, 2007 (FR) ..... 07 52854

(51) Int. Cl.
*B65H 23/00* (2006.01)
*B26F 3/00* (2006.01)

(52) U.S. Cl. ..... 242/566; 242/564; 242/564.4; 225/2; 225/96; 83/337

(58) Field of Classification Search ..... 242/564, 242/564.1, 564.3, 564.4, 565, 579, 580; 83/335, 83/337, 649, 937, 322, 345, 650, 342; 225/93, 225/6, 16, 12, 2, 34, 96
See application file for complete search history.

(56) References Cited

U.S. PATENT DOCUMENTS

| | | | | |
|---|---|---|---|---|
| 4,846,035 | A * | 7/1989 | Granger | 83/337 |
| 6,450,076 | B1 * | 9/2002 | Granger | 83/334 |
| 7,234,381 | B2 * | 6/2007 | Granger | 83/649 |
| 2002/0030075 | A1 * | 3/2002 | Granger | 225/16 |
| 2004/0188486 | A1 * | 9/2004 | Granger | 225/93 |
| 2004/0251375 | A1 * | 12/2004 | Denen et al. | 242/563 |
| 2005/0051005 | A1 * | 3/2005 | Broehl | 83/13 |
| 2005/0051008 | A1 * | 3/2005 | Granger | 83/335 |
| 2007/0221777 | A1 * | 9/2007 | Valot | 242/560 |

* cited by examiner

FOREIGN PATENT DOCUMENTS

| | | |
|---|---|---|
| EP | 1083816 B1 | 6/2003 |
| FR | 2828084 A | 2/2003 |

OTHER PUBLICATIONS

International Search Report for PCT/FR2008/050106 dated Aug. 13, 2008.

*Primary Examiner* — William A Rivera
(74) *Attorney, Agent, or Firm* — Heslin Rothenberg Farley & Mesiti P.C.

(57) ABSTRACT

A device for loading strips of wipe material for wipe material dispensing machines of the type including a housing that accommodates lateral side pieces which support a drum including a cutting device and a strip of material located above the drum, is distinctive in that it comprises a dual arrangement with, firstly, an enclosure that is concentric with the drum and defines, together with the drum, a gap through which the strip of material passes and, secondly, at least two rollers arranged parallel to each other and rotatably mounted relative to the lateral side pieces of the housing and meshing with a sprocket joined to the drum. An intermediate roller is fitted between the at least two rollers and make it possible to insert the strip of material into the gap between the enclosure and the drum and then eject it towards the front of the machine.

7 Claims, 3 Drawing Sheets

Fig. 5
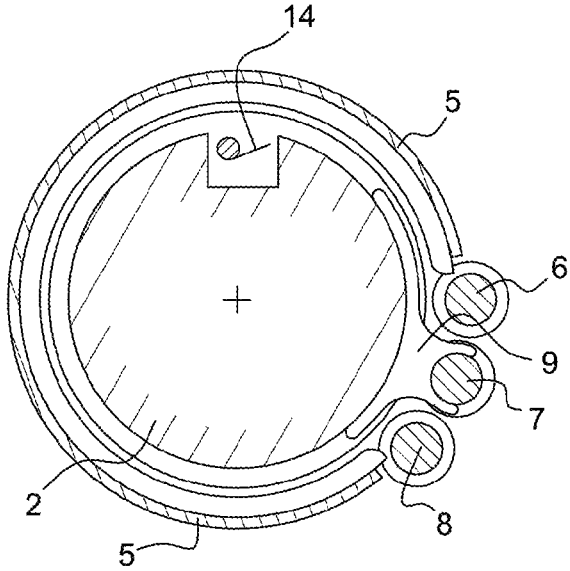
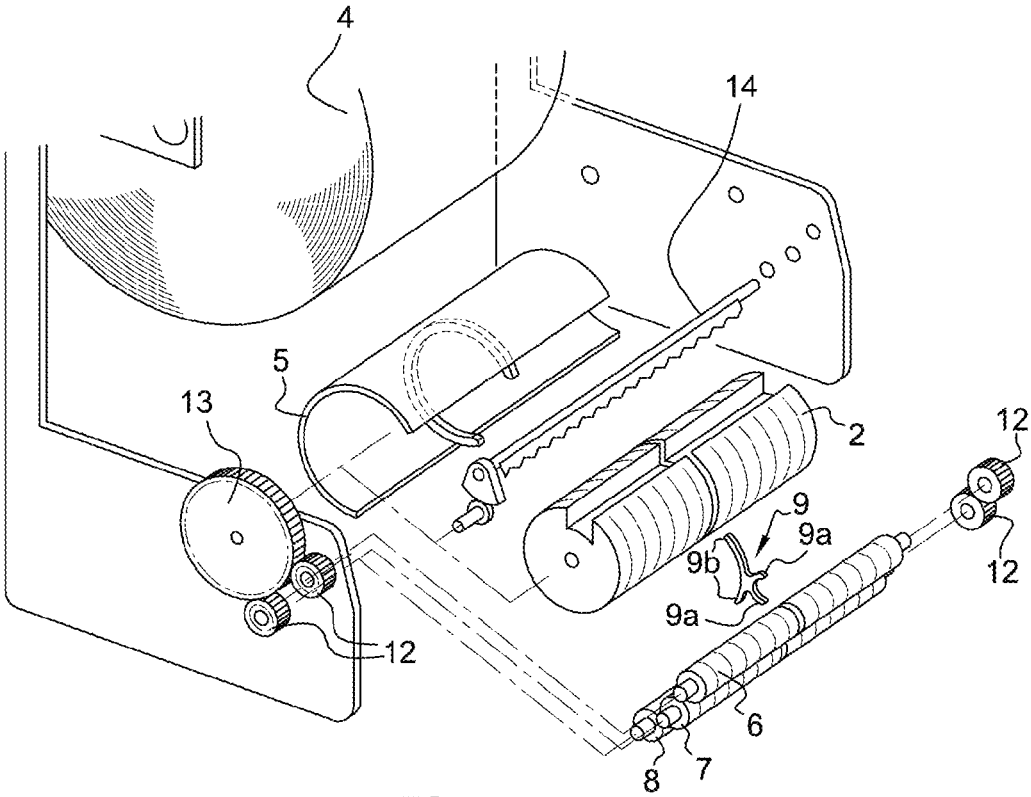
Fig. 6

DEVICE FOR LOADING STRIPS OF WIPING MATERIAL FOR WIPING MATERIAL DISPENSING APPARATUSES

CROSS REFERENCE TO RELATED APPLICATIONS

This application is a national stage filing under section 371 of International Application No. PCT/FR2008/050106 filed on Jan. 24, 2008, and published in French on Sep. 12, 2008 as WO 2008/107608 and claims priority of French application No. 0752854 filed on Jan. 24, 2007, the entire disclosure of these applications being hereby incorporated herein by reference.

BACKGROUND ART

The invention relates to the technical field of dispensing machines for wipe materials with automatic or semi-automatic cutting which have applications for paper hand wipes, general-purpose paper wipes, toilet paper and similar wipes.

A machine of this type according to the prior art is illustrated, in particular, in FIG. 1 and comprises one housing (1) that accommodates lateral side pieces (1*a*) which support drum (2) including its cutting device, a pressure roller (3) resting on said drum and a reel of material (4) located above the drum. The strip of material obtained from the reel therefore follows the trajectory represented by arrow (F) so that its end is inserted between the pressure roller and the drum and wraps round the latter when the drum rotates with a view to cutting a section of the strip of material.

The problem encountered is that of controlling the tension of the paper depending on its technical characteristics which can vary from one market to another.

Another problem encountered is that of how to improve safety when inserting the strip of material between the pressure roller and the drum. Faced with these problems, the Applicant has devised a simple solution that ensures loading of the reel of material under optimum safety conditions and also improves the quality of support provided for the strip of material on the drum as it is inserted.

The solution provided by the Applicant is simple and easy to implement.

These objects and others will become apparent from the following description.

BRIEF SUMMARY OF INVENTION

According to a first aspect of the invention, the device for loading strips of wipe material for wipe material dispensing machines of the type including a housing that accommodates lateral side pieces which support a drum including a cutting device and a strip of material located above the drum is distinctive in that it comprises a dual arrangement with, firstly, a guiding means which is concentric with said drum and defining, together with the latter, a gap through which the strip of material passes and, secondly, at least two rollers arranged parallel to each other and rotatably mounted relative to the lateral side pieces of the housing and in that an intermediate means between the rollers makes it possible to insert the strip of material into the space formed between the enclosure and the drum and then eject it towards the front of the machine.

These aspects and others will become apparent from the following description.

BRIEF DESCRIPTION OF DRAWING FIGURES

The object of the present invention is described, merely by way of example, in the accompanying drawings in which:

FIG. 5 is a cross-sectional view showing the arrangement of the drum with its protective enclosure.

FIG. 6 is a partial view of the lower part of the dispensing machine accommodating the means according to the invention.

DETAILED DESCRIPTION

In order that the object of the invention may more readily be understood, the following description is given, merely by way of example, reference being made to the accompanying drawings.

Figure 1:
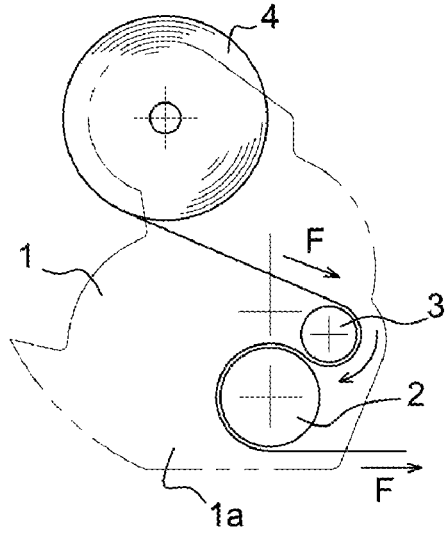
Fig. 1 PRIOR ART
FIG. 1 is a schematic view of a wipe material dispensing machine according to the prior art with a pressure roller that rests on the drum.
Figure 2:
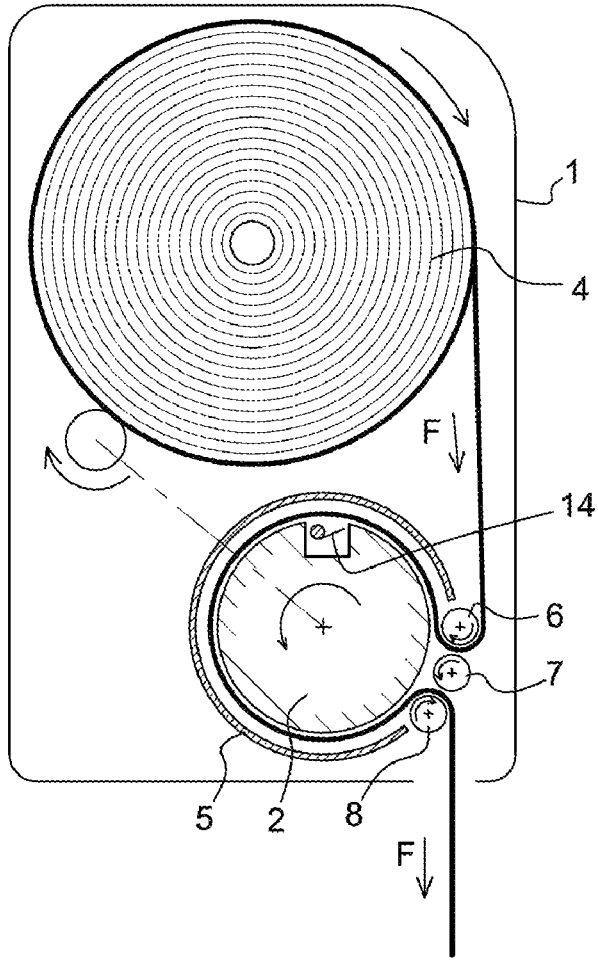
FIG. 2 is a schematic view of the device for loading the reel of material according to the invention, this view being a side view.
Figure 3:
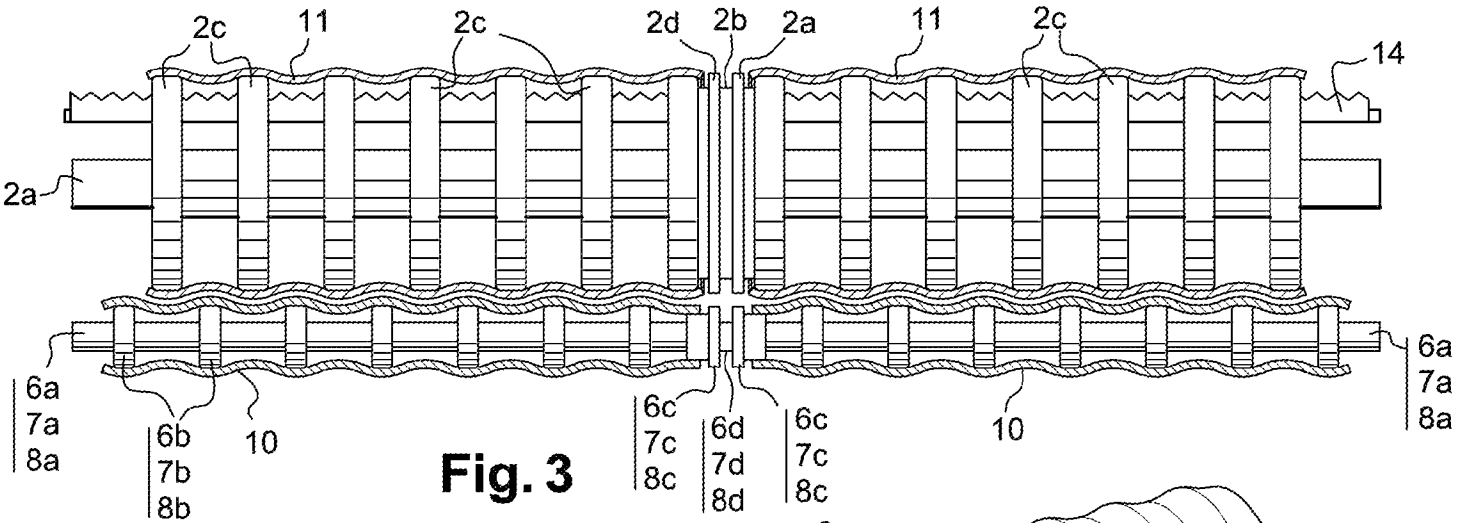
FIG. 3 is a partial cross-sectional view showing the configuration of the drum and of one of the rollers of the device according to the invention.
Figure 4:
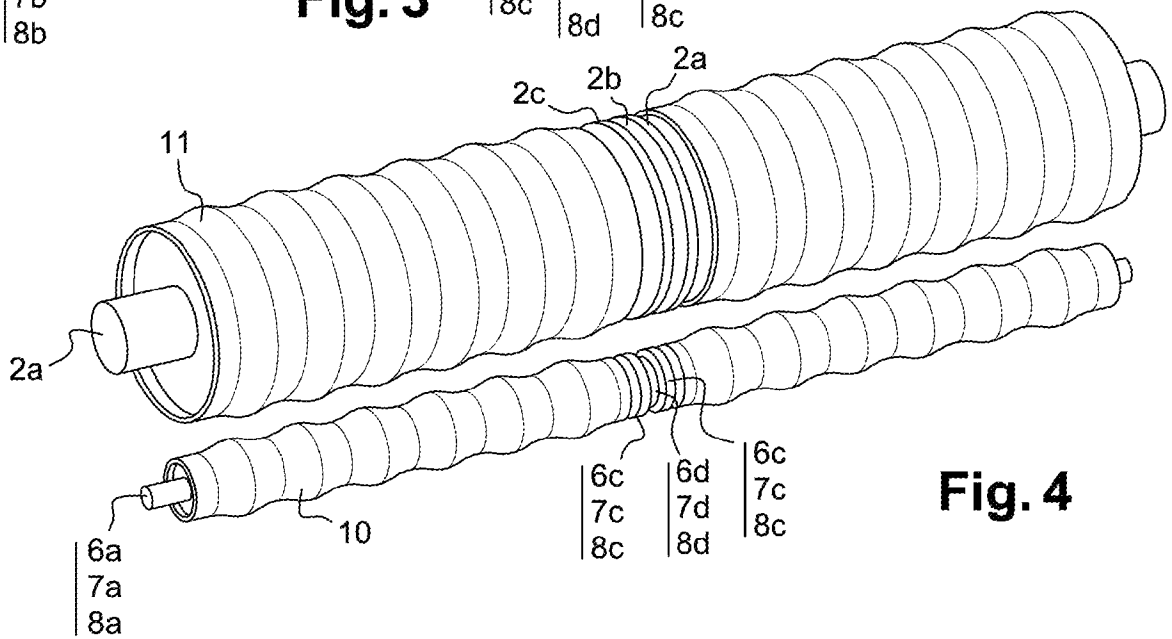
FIG. 4 is a view similar to FIG. 3 showing the drum and of one of the rollers of the device according to the invention.

The device for loading the strip of material, from a reel, as shown in the drawings or having a continuous length which is pleated, in a wipe material dispensing machine includes a dual arrangement with, firstly, drum (2) being covered by a guiding means for example an outer enclosure (5) which is concentric with said drum and defines, together with the latter, a gap through which the strip of material passes. This enclosure (5) is fixed, in any known appropriate manner, to the lateral side pieces of the housing or is moulded as part of said housing when it is manufactured. This enclosure is not closed and has an access area that opens out towards the front of the machine. Facing this enclosure and the drum, there are at least two rollers (6, 8) arranged parallel to each other and rotatably mounted relative to the lateral side pieces of the housing and meshed relative to a sprocket joined to the drum and intermediate means (7) between said rollers (6-8). This intermediate means may itself be a third roller as shown in the drawings. In this case, these rollers turn in an opposite direction and make it possible to insert the strip of material into the space formed between the enclosure and the drum and then eject it towards the front of the machine. The strip of material is inserted between upper roller (6) and intermediate roller (7) as shown in FIG. 2 and the strip of material is ejected from between intermediate roller (7) and lower roller (8).

These three rollers are of similar construction and have a central core (6*a*, 7*a*, 8*a*) along which there are discs (6*b*, 7*b*, 8*b*) that are parallel to each other with a predetermined spacing pitch. In the middle part of these rollers, there is provision for positioning two discs (6*c*, 7*c*, 8*c*) that between them define a groove (6*d*, 7*d*, 8*d*) for the movement and insertion of a part that guides (9) the strip of material. These rollers are capable of receiving sleeves (10) made of an elastomer material which, by their very configuration, define successive corrugations or ripples. Similarly, drum (2) comprises a central core (2*a*) that accommodates a number of discs (2*c*) equivalent to the number of discs formed on the rollers with one disc less per half of the drum. The drum also accommodates two discs (2*d*) in its middle position which define a groove (2*b*) between them and leave room for above-mentioned guide (9). The drum is fitted with sleeves (11) made of an elastomer material. According to one important feature of the invention, the corrugations formed on the rollers and on the drum are offset half a pitch interval from each other, so that there is a continuous pressure effect and ripples are formed on the strip of material inserted between rollers (6, 7), (7, 8) and drum (2) during phases when the strip of material is fed in and ejected.

Upper roller (6) and lower roller (8) turn in the opposite direction to the drum and central intermediate roller (7) turns in the same direction as the drum. It is central roller (7) which, during loading, forces the paper to enter and then emerge from the machine. Upper roller (6) and lower roller (8) may be in contact with the drum, whereas central roller (7) is not. The rollers may assist cutting by pulling the paper as they rotate, thus the diameter of upper roller (6) is 0.3 to 0.5 mm less than the diameter of the central intermediate roller and the same applies to the lower roller. The diameter of the latter is 0.3 to 0.5 more than that of the intermediate roller. As shown in FIG. 6, the ends of the rollers (6, 7 and 8) are fitted with drive sprockets (12) which allow, through transfer mechanisms that are not shown, rotation of the rollers in association with drum (2) and its sprocket (13).

Alternatively, intermediate means (7) may consist of guide protrusions arranged parallel to rollers (6-8) allowing movement of the strip of material. These guide protrusions over all or part of the length of rollers (6-8) are, for example, formed on a swivelling flap mounted on the dispensing machine and make it possible to load the standby strip of material.

Advantageously, the front part of guide (9) has a double tip (9*a*) that clips into the groove formed on the intermediate roller and partially penetrates into the grooves formed on the upper and lower rollers. The rear part of the guide has two other prongs (9*b*) that fit into the groove formed on the drum, this makes it possible to load the strip of material in complete safety.

Thus, according to the invention, one obtains better retention of the strip of material thanks to the combined support from the corrugations formed on the drum and the rollers which act in the valley and peak configurations, the strip of material is held perfectly without any pressure and there is no need for any additional means of the spring type in order to fulfil this pressure function. The three rollers have a material guidance and retention function but they are not pressure rollers. Safety is improved because there is no possibility of inserting one's fingers because there is no space.

The cutting device is protected by the enclosure 5 that surrounds the drum 2. Rotation of the drum and ejection of the cutting blade 14 take place in a known manner.

The invention claimed is:

1. A wipe material dispensing machine having a device for loading strips of wipe material, the dispensing machine comprising a housing having lateral side pieces which support a drum including a cutting device, and a strip of material located above the drum, wherein the drum is covered by an outer enclosure that is concentric with said drum and defines, together with the drum, a gap through which the strip of material passes and, further comprising at least two rollers arranged parallel to each other and rotatably mounted relative to the lateral side pieces and being located in an access area opened up relative to said enclosure and meshing with a sprocket joined to the drum, and an intermediate means fitted between the rollers to insert the strip of material into the gap between the enclosure and the drum and then eject the strip of material towards a front of the machine.

2. A device as claimed in claim 1, wherein the intermediate means comprises a third roller mounted parallel to the at least two rollers.

3. A device as claimed in claim 2, wherein the at least two rollers and the third roller are of similar construction and have a central core along which there are discs parallel to each other with a predetermined spacing pitch and in a middle part of the rollers there are two discs that between them define a groove for movement and insertion of a guide for guiding) the strip of material, and the rollers receive sleeves that by their configuration, define successive corrugations or ripples, and the drum comprises a central core having a number of discs equivalent to a number of discs on the rollers, and the drum also has two discs in its middle position defining a groove between them allowing movement of the guide, and the drum is fitted with sleeves.

4. A device as claimed in claim 3, wherein corrugations formed on the rollers and on the drum are offset half a pitch interval from each other, so that there is a continuous pressure effect and ripples are formed on the strip of material inserted between the rollers and the drum during phases when the strip of material is fed in and ejected.

5. A device as claimed in claim 3, wherein a front part of the guide has a double tip that clips into the groove formed on the third roller and partially penetrates into the groove formed on the at least two rollers, and a rear part of the guide has two other prongs that fit into the groove formed on the drum.

6. A device as claimed in claim 1, wherein the outer enclosure is attached to the lateral side pieces of the housing, is not closed and has an access area that opens out towards a front of the machine and allows opposite-facing positioning of the at least two rollers.

7. A device as claimed in claim 1, wherein the ends of the at least two rollers are fitted with drive sprockets that cooperate with the sprocket.

* * * * *